US006046544A

United States Patent [19]

Daemen et al.

[11] Patent Number: 6,046,544

[45] Date of Patent: Apr. 4, 2000

[54] HIGH-PRESSURE METAL HALIDE DISCHARGE LAMP

[75] Inventors: Catharina J. M. Daemen, Eindhoven, Netherlands; Ann M. M. Smolders; Francis J. C. Vandijck, both of Turnhout, Belgium

[73] Assignee: U.S. Philips Corporation, New York, N.Y.

[21] Appl. No.: 09/210,417

[22] Filed: Dec. 11, 1998

[30] Foreign Application Priority Data

Dec. 22, 1997 [EP] European Pat. Off. ..... 97204058

[51] Int. Cl.[7] ..... H01J 17/04

[52] U.S. Cl. ..... 313/633; 313/570; 313/346 R

[58] Field of Search ..... 313/633, 630, 313/346 R, 491, 574, 570, 575, 631, 632

[56] References Cited

U.S. PATENT DOCUMENTS 5,530,317 6/1996 Willemsen et al. ..... 313/633

*Primary Examiner*—Nimeshkumar D. Patel
*Assistant Examiner*—Todd Reed Hopper
*Attorney, Agent, or Firm*—F. Brice Faller

[57] ABSTRACT

The high-pressure metal halide discharge lamp comprises a quartz-glass lamp vessel (1) with an ionizable filling and two electrodes (2) which are connected to current conductors (3). The electrodes are provided with an emitter (6) which contains tungsten as a main component and at least three oxides, a first oxide which is chosen from hafnium oxide and zirconium oxide, a second oxide being lanthanum oxide, and a third oxide which is chosen from yttrium oxide.

6 Claims, 1 Drawing Sheet

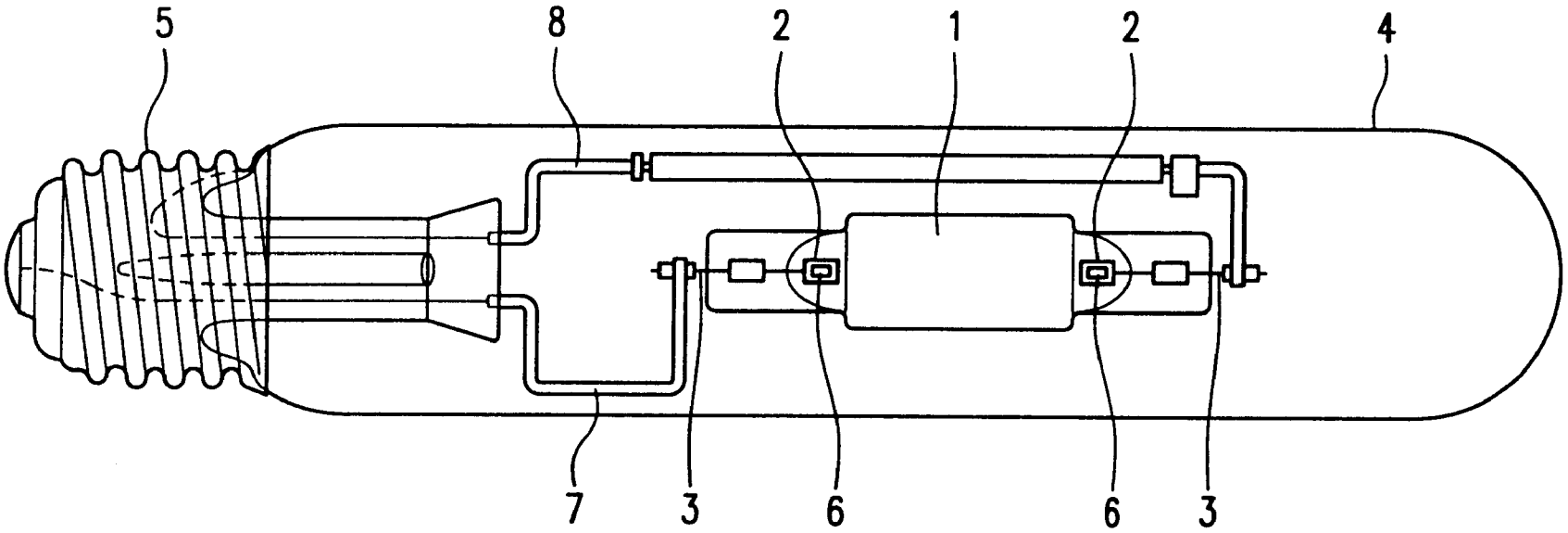
4
2
1
2
8
5
3
6
6
3
7

HIGH-PRESSURE METAL HALIDE DISCHARGE LAMP

BACKGROUND OF THE INVENTION

The invention relates to a high-pressure metal halide discharge lamp comprising a light-transmitting lamp vessel which is sealed in a vacuumtight manner and contains an ionizable filling including an inert gas and a metal halide, tungsten electrodes are provided with an emitter comprising, as a main constituent, tungsten which includes at least a first oxide selected from hafnium oxide and zirconium oxide, and furthermore at least a further oxide selected from the group of oxides of the elements yttrium, lanthane and the lanthanides, the electrodes and emitter being substantially free of thorium oxide.

Such a high-pressure metal halide discharge lamp is known from EP-A1-0 647 964 U.S. Pat. No. 5,30,317). This lamp has an emission spectrum and a color point which are determined, inter alia, by its ionizable filling. And, at or near their free ends, the electrodes of the known lamp are provided with an emitter. The emitter comprises 7 to 30% by volume of oxides.

An electrode having an emitter has a lower electron work function and, as a result, its temperature during operation is lower than that of an electrode without an emitter. Consequently, evaporation of electrode (and emitter) material and the deposition thereof on the lamp vessel occur to a smaller degree. As a result, the lamp having an electrode with an emitter has a better maintenance; its luminous efficacy (lm/W) during its service life exhibits a smaller decrease than that of a lamp having an electrode without an emitter. A second property of an emitter is that it leads to a shorter glow time during starting of the lamp. As a result, the starting behavior of the lamp is better and less electrode (and emitter) material is sputtered onto the wall, resulting in a better maintenance.

It is also known that a combination of the oxides in tungsten yields an emitter having suitable properties in a high-pressure metal halide discharge lamp. Although the electrodes of the known high-pressure metal halide discharge lamp are substantially free of thorium oxide, the electrodes have an at least substantially equal work function potential. This is remarkable because essential properties which are combined in thorium oxide are not present in the individual oxides used in the emitter. Consequently, in the first instance, the conclusion should be drawn that the individual oxides are hardly suitable for use as an emitter. A possible explanation for the positive effect of the combination of oxides could be that the first oxide has formed a compound, for example having a fluorite structure, with the further oxide.

The tungsten of the emitter has a grain structure with grain boundaries. In this structure, the fluorites demonstrate a great stability and immobility. The fluorites are so immobile that they hardly, or not at all, diffuse from the mass of the emitter along the grain boundaries to an electron-emitting surface. As a result, the supply of oxides present in this form in the emitter to the electron-emitting surface is reduced very substantially. It has been found however, that, in the known lamp, the discontinuation of the supply of oxide leads, during the service life, to a premature depletion of the electron-emitting surface. This premature depletion is counteracted in the known lamp by using emitters having relatively large quantities of oxides, for example the first oxide.

The known lamp comprising electrodes with the known emitter has the disadvantage that much oxide evaporates in the early stage of the service life of the lamp, which can be attributed to the presence of the oxides in relatively high concentrations in the electron-emitting surface. This results, on the one hand, in the maintenance again lagging behind that of lamps with thorium, because the relatively rapidly evaporated oxide deposits on the lamp vessel and hence adversely affects the light transmissivity, and, on the other hand, in a relatively large change in color point as a result of a reaction of the oxides with the ionizable filling present in the lamp. As a result of this reaction, during the service life, a change of the gas composition of the filling of the lamp takes place when the lamp is in the operational state. The color point with co-ordinates (x, y, z) changes particularly in its x-co-ordinate.

SUMMARY OF THE INVENTION

In accordance with the invention, the further oxide is lanthanun oxide as a second oxide and at least an oxide selected from the group of elements 39 and 58 through 71 as a third oxide, the second oxide accounting for M mol % of the sum of the second oxide and the first oxide, the third oxide having a weight percentage M3 in the emitter, and M and M3 having the values listed in Table 1

TABLE 1

| first oxide (I) | second oxide (II) | M (mol % II) | third oxide (III) atomic no. | M3 (absolute wt.% III in the emitter) |
|---|---|---|---|---|
| $ZrO_2$ | $La_2O_3$ | 48–98 | 39 | 0.05–10 |
| $HfO_2$ | $La_2O_3$ | 48–98 | 39 | 0.05–10 |
| $ZrO_2$ | $La_2O_3$ | 48–98 | 58 through 71 | 0.05–15 |
| $HfO_2$ | $La_2O_3$ | 48–98 | 58 through 71 | 0.05–15 |

The inventors have realized that in order to achieve, during the service life, said favorable emitter properties, that is a short glow time, a permanently low work function and a slow evaporation of oxide by a continuous, uniform supply of oxide, via diffusion, from the mass of the emitter, the emitter must comprise the oxides in suitable quantities and ratios in the tungsten. The values M and M3 of the oxides in the emitter listed in Table 1 lead to the desired result. The supply of oxides from the mass of the emitter is dependent upon their diffusion rate and concentration. Apart from the temperature of the electrode, this supply also depends on the absolute quantity of oxide, the manner in which the oxides are bound in the emitter and the transportability of the oxide through the grain structure along the grain boundaries of the tungsten grains in the emitter.

The loss of oxides from the emitter also depends on the quantity of oxides present in the emitter. If a large quantity of oxides are present, particularly in the early stage during operation of the lamp, much oxide will evaporate due to the high concentrations of oxide in the electron-emitting surface. This will take place in spite of the fact that these oxides may be trapped in the mass of the emitter and the supply from the mass to the electron-emitting surface takes place slowly.

It is known that the structure of the mass of the emitter plays an important role in the degree to which and manner in which the emitter evaporates. Examination of the emitter has revealed that the presence of each of the three oxides is required to achieve good emitter properties and that each individual oxide makes its own specific contribution.

It has been found that lanthanum oxide is necessary to obtain a good maintenance and color point stability of the lamp. In this connection, it is important that sufficient free lanthanum oxide, that is not bound to the first oxide in the fluorite structure, remains in the emitter during the service life. To achieve this, the ratio between the first oxide and lanthanum oxide is subject to a limitation. Consequently, a lamp in accordance with the invention always comprises lanthanum oxide which is present in the emitter in a partly unbound state, and said unbound part is not hampered, in its transport behavior through the mass of the emitter, by a compound with zirconium oxide.

Zirconium oxide and yttrium oxide are important for both the supply and the evaporation of the emitter, but in particular for evaporation of the oxides. Zirconium oxide influences the transport of oxides in that it forms very stable compounds with lanthanum oxide and yttrium oxide, which compounds, for example, have a fluorite-type structure. Zirconium oxide also influences the transportability of oxides along the grain boundaries, inter alia by keeping the grain boundaries open. Yttrium oxide has a grain-growth inhibiting effect on tungsten grains, so that the grain structure of the tungsten is controlled and the grains remain small. As a result, the transportability, for example by diffusion, of oxides from the mass to the electron-emitting surface is influenced such that the supply is prolonged and more uniform. In addition, yttrium oxide reduces the work function of the electrons leaving from the electrode.

By influencing, via zirconium oxide and yttrium oxide, the transportability of oxides along the grain boundaries, a lengthy and relatively low-dose, uniform supply from the mass to the electron-emitting surface is possible. The oxides can evaporate only when they have reached the electron-emitting surface. Subsequently, said electron-emitting surface is provided with oxides by diffusion from the mass. By said dosed, uniform supply, there is always sufficient oxide at the electron-emitting surface during the service life of the lamp, so that when the lamp is started, the glow time of the electrode is short and, when the lamp is in the operational state, the work function and hence the electrode temperature, remains low. By virtue of the relatively low concentration of oxides at the electron-emitting surface, also the evaporation of oxides is low. This results in an improved maintenance and color point stability of the high-pressure metal halide discharge lamp.

Unlike known emitters, the weight percentage of the first oxide in the electrode in the lamp in accordance with the invention is small, preferably in the range between 0.05 and 0.5 percent by weight of the mass of the emitter. Weight percentages above 0.5% by weight of the first oxide readily lead to the formation of so many stably bound second and third oxides that it is likely that, during the service life of the lamp, premature depletion phenomena occur at the electron-emitting surface. In further research it has been found that low percentages by weight of the first oxide are sufficient to achieve a sufficiently open tungsten-grain structure, and that the transport of oxide to the electron-emitting surface is controlled even better than at higher percentages by weight of this first oxide. At these low percentages by weight of the first oxide, premature depletion phenomena hardly occur if the percentage by weight of the first oxide is above 0.05 percent by weight. As a result, the maintenance and color point stability of a lamp in accordance with the invention is improved relative to a known lamp of the same type, while the glow time and the work function remain sufficiently small.

In a favorable embodiment, the emitter can be optimized as regards evaporation of the oxides by choosing a minimal quantity of the first oxide in combination with a quantity of lanthanum oxide which is bound by the first oxide in the fluorite structure. Preferably, the joint percentage by weight of the first and the second oxide ranges between 1 and 3 percent by weight of the mass of the emitter. It has been found that a percentage by weight of the first and the second oxide above 3 percent by weight does not lead to a useful reduction of the glow time and of the work function, but leads to an increased risk of an unnecessarily large loss of oxides from the emitter by evaporation. If the percentage by weight is below 1 percent by weight, both the reduction of the glow time and of the work function, and hence the temperature reduction of the electrode, are so small that they are considered insufficient. As a result of the relatively long glow time and the high electrode temperature at such low percentages by weight, the evaporation of tungsten will increase substantially, thus causing a worse maintenance of the lamp.

In a further embodiment, the evaporation of oxides is limited in that the first, second and third oxide together account for maximally 10 percent by weight of the mass of the emitter. A higher percentage by weight does not lead to a usable reduction of the work function, but instead to an increase in the evaporation of the oxides, which is unfavorable for the color point stability.

The emitter can be used in various ways, for example in a pellet or in a sintered electrode, as in the known lamp. In the case of lamps having a very high electrode temperature in the operational state, for example HPI lamps having an electrode temperature during operation of 2500 K and higher, the use of an emitter in a sintered electrode is not possible because the emitter is depleted too rapidly and, as a result, the lamp exhibits a poor starting and maintenance behavior. In these lamps, the emitter is favorably arranged in a pellet, for example in the electrode spiral. Since the pellet is sufficiently thermally insulated from the electrode spiral, the electrode becomes sufficiently hot, during starting of the lamp, to ensure a good starting behavior. During operation of the lamp, the pellet contributes to the heat dissipation in order to keep the electrode spiral at a lower and hence more favorable temperature with respect to the same electrode without pellet under the same conditions.

The use of cooling members in electrodes of high-pressure metal halide discharge lamps is known per se from EP-A2-0 756 312. These cooling members are sintered and mainly composed of tungsten or molybdenum to which, distributed in their mass, a sinter-active component is added in a quantity of approximately 1% by weight, for example nickel or platinum. However, this construction is relatively expensive due to the expensive sinter-active component. In addition, the cooling members do not have emitter properties.

To examine the emitter, this material was tested in a pellet. The pellet was manufactured by means of various suitable techniques, such as the sol-gel method, ball mill etc. The emitter may however alternatively be used in sintered electrodes. Preferably it is used in the lamp in accordance with the invention comprising electrodes to which the emitter in a pellet is added. This pellet may be arranged in the electrode.

The tungsten of the electrodes and of the pellet may contain impurities and the customary additives controlling the grain growth of tungsten, such as potassium, aluminium and silicon up to a total content of, for example, 0.01% by weight of the tungsten. As a result of said additives, coarsening of the tungsten grains during the service life of the lamp, which leads to an undesirable acceleration of the loss of oxide from the pellet, is slowed down.

Dependent upon the type of high-pressure metal halide discharge lamp, the electrodes may have various shapes and dimensions. For example, an electrode may be wound at or near its free end with, for example, tungsten wire of, for example, the tungsten material from which the electrode itself is made. Such a winding can be used for providing a desired temperature gradient across the electrode during operation of the lamp, for accommodating the pellet or for facilitating the starting process. Alternatively, the electrodes may be, for example, of spherical or hemispherical shape at their free end.

The electrodes may be arranged, for example, next to or opposite one another in the lamp vessel. The lamp vessel may be made of a glass having a high $SiO_2$ content, for example quartz glass, but alternatively, for example, of a crystalline material such as quartz or polycrystalline aluminium oxide or sapphire. The lamp vessel may be accommodated in a closed outer bulb, if so desired.

BRIEF DESCRIPTION OF THE DRAWINGS

An embodiment of the high-pressure metal halide discharge laI in accordance with the invention is shown in FIG. 1 in side elevation.

DETAILED DESCRIPTION OF THE PREFERRED EMBODIMENTS

In FIG. 1, the high-pressure metal halide discharge lamp is provided with a light-transmitting lamp vessel 1, made of quartz glass in the drawing, which is closed in a vacuumtight manner. The lamp vessel contains an ionizable filling with an inert gas and a metal halide. The filling of the lamp shown comprises mercury, iodides of sodium, indium, thallium and an inert gas composed of a mixture of 99.8% by volume neon and 0.2% by volume krypton with a filling pressure of 50 mbar. Tungsten electrodes 2 are arranged in the lamp vessel and connected to current conductors 3, made of molybdenum in the Figure, which issue to the exterior through the lamp vessel and are connected to a lamp cap 5 via electrical contacts 7 and 8. The electrodes are provided with an oxidic electron emitter in a pellet 6. The lamp shown has a hard-glass outer bulb 4 which carries the lamp cap 5.

The pellet 6 of each of the electrodes is substantially free of thorium oxide and has, distributed in its mass, a first oxide selected from hafnium oxide and zirconium oxide, lanthanum oxide as the second oxide, and an oxide of one of the elements with atomic number 39 and 58 through 71 as the third oxide, the second oxide accounting for M mol % of the sum of the second oxide and the first oxide, M3 accounting for the absolute percentage by weight in the emitter of the third oxide, M and M3 having the values listed in Table 1.

TABLE 1

| first oxide (I) | second oxide (II) | M (mol % II) | third oxide (III) atomic no. | M3 (absolute wt.% III in the emitter) |
|---|---|---|---|---|
| $ZrO_2$ | $La_2O_3$ | 48–98 | 39 | 0.05–10 |
| $HfO_2$ | $La_2O_3$ | 48–98 | 39 | 0.05–10 |
| $ZrO_2$ | $La_2O_3$ | 48–98 | 58 through 71 | 0.05–15 |
| $HfO_2$ | $La_2O_3$ | 48–98 | 58 through 71 | 0.05–15 |

The lamp shown has a power consumption of 400 W.

Lamps were manufactured comprising electrodes with emitters of different compositions, in accordance with the invention in a pellet, and compared with lamps which have emitters of different compositions but which are identical in all other respects. The pellets were manufactured by mixing tungsten powder with powder of the relevant oxide(s). The mixture was densified and sintered, thereby forming rod-shaped pellets having a thickness of approximately 1.5 mm and a high density of approximately 95% of the theoretical density. Pellets of different density may also be used, however, for other types of lamps, such as types containing a rare earth metal in the filling.

The lamps were operated for 2000 hours, whereafter their maintenance (maint.) was measured and their color point shift (Δclpt.). The emitter compositions and lamp results are listed in Table 2. For comparison, compositions and results are listed of lamps having an emitter in accordance with the state of the art.

TABLE 2

| emittercomposition (in % by weight of the mass of tungsten = oxides) | M (mol %) | M3 (% by weight) | maint. (%) | Δ clpt. |
|---|---|---|---|---|
| W + 4 wt. % $ThO_2$ | — | 0 | 93.8 | 2 |
| W + 10 wt. % $Y_2O_3$ | — | 10 | 91.0 | 24 |
| W + 7.6 wt. % $HfO_2$ + 5.7 wt. % $Y_2O_3$ | 0 | 5.7 | 89.2 | 19 |
| W + 5.3 wt. % $HfO_2$ + 5.7 wt. % $Y_2O_3$ | 33 | 0 | 97.3 | 26 |
| W + 0.1 wt. % $ZrO_2$ + 2 wt. % $La_2O_3$ + 0.1 wt. % $Y_2O_3$ | 88 | 0.1 | 93.1 | 12 |
| W + 0.1 wt. % $ZrO_2$ + 2 wt. % $La_2O_3$ + 6 wt. % $Y_2O_3$ | 88 | 6 | 94.0 | 6 |

Table 2 shows that the lamp in accordance with the invention having emitter compositions containing three oxides and $ZrO_2$ and $La_2O_3$ in a mutually favorable molar ratio, for example W+0.1% by weight $ZrO_2$+2% by weight $La_2O_3$+6% by weight $Y_2O_3$, has a good maintenance and a small color point shift. The use of an emitter composition comprising only W+$ThO_2$ results in a lamp of equal properties. The other lamps comprising emitter compositions with only one or two oxides exhibit, in all cases, a considerable and, in practice, unfavorable color point shift. For practical applications, a difference in color point of 15 points or more is experienced as disturbing. In many cases, also the maintenance of the lamp is worse than that of the lamp in accordance with the invention, for example W+7.6% by weight $HfO_2$+5.7% by weight $Y_2O_3$; W+10% by weight $Y_2O_3$.

The above-described results clearly show the synergy of the three oxides.

We claim:

1. A high-pressure metal halide discharge lamp comprising a light-transmitting lamp vessel which is sealed in a vacuumtight manner and contains an ionizable filling including an inert gas and a metal halide, and in which tungsten electrodes are arranged, which are connected to current conductors which issue to the exterior through the lamp vessel, which electrodes are provided with an emitter comprising tungsten and a first oxide selected from hafnium oxide and zirconium oxide, a second oxide consisting of lanthanum oxide, and a third oxide consisting of at least one oxide selected from the group of oxides of the elements yttrium and the lanthanides, said electrodes and emitter being substantially free of thorium oxide, the second oxide accounting for M mol % of the sum of the second oxide and the first oxide, the third oxide having a weight percentage M3 in the emitter, and M and M3 having the values listed in Table 1

TABLE 1

| first oxide (I) | second oxide (II) | M (mol % II) | third oxide (III) atomic no. | M3 (absolute wt.% III in the emitter) |
|---|---|---|---|---|
| $ZrO_2$ | $La_2O_3$ | 48–98 | 39 | 0.05–10 |
| $HfO_2$ | $La_2O_3$ | 48–98 | 39 | 0.05–10 |
| $ZrO_2$ | $La_2O_3$ | 48–98 | 58 through 71 | 0.05–15 |
| $HfO_2$ | $La_2O_3$ | 48–98 | 58 through 71 | 0.05–15. |

2. A lamp as claimed in claim 1, characterized in that the first oxide is zirconium oxide and the third oxide is yttrium oxide.

3. A lamp as claimed in claim 1, characterized in that the first oxide accounts for 0.05–0.5 percent by weight of the mass of the emitter.

4. A lamp as claimed in claim 1, wherein the first oxide and the second oxide together account for 1–3% by weight of the mass of the emitter.

5. A lamp as claimed in claim 1, wherein the mass of the first, second and third oxide together account for maximally 10% by weight of the mass of the emitter.

6. A lamp as claimed in claim 1, wherein the emitter is present in a pellet.

* * * * *